10B
46
44
10
37
34
33
30
36
38
50
31
4
42
40
48

10
14
14A
22
18
12
20
24
16
48

ROTATABLE LAMP SOCKET FOR INCANDESCENT PEDESTRIAN TRAFFIC SIGNAL, OR THE LIKE

The pedestrian traffic signal described above is of the type disclosed in Copending Application Ser. No. 810,168, filed June 27, 1979 in the names of the present inventors.

BACKGROUND

Pedestrian traffic signals are presently in widespread use. Most pedestrian traffic signals are of the type which include a rectangular case, and a face plate mounted on the case which has an upper portion bearing the legend "DONT" and a lower portion bearing the legend "WALK". In the neon-type of traffic signal, neon tubes are mounted within the case, and the neon tubes are selectively energized at relatively high voltage by transformers which are also mounted in the case. When one of the neon tubes is energized, the words "DONT WALK" on the face plate are illuminated in a first color; and when another of the neon tubes is energized, only the word "WALK" on the face plate is illuminated in a second color. In accordance with Federal Standardization Procedures, in order to avoid confusion with vehicular traffic signals, the first color has been selected to be Portland orange, and the second color to be lunar white.

The invention of the copending application provides a pedestrian traffic signal unit which may be mounted in an existing neon tube rectangular case. The unit includes a housing shaped, as described, and which contains two incandescent lamps respectively mounted in the two compartments of the housing. Since the incandescent lamps operate at relatively low voltage, as compared with neon tubes, no transformers are required in the case. In a constructed embodiment of the invention of the copending application, 116 watt incandescent lamps have been found to provide the light intensity required for normal operation, and the lamps may be directly energized by the 120-volt 60 Hz electric mains.

Incandescent lamps are constructed to have an arcuate filament which is supported within the lamp envelope on appropriate wire supports, the wire supports also supplying the electric current to the filament. It has been found that for long life, the incadescent lamp must be supported in an angular position, such that the arcuate filament hangs down from the wire supports. For this reason, various attempts have been made in the past to provide rotatable sockets for the incandescent lamps, so that they may be rotated to their correct angular position. The objective of the present invention is to provide such a rotatable socket which is simple in its construction, and which is easy to operate.

DETAILED DESCRIPTION OF THE ILLUSTRATED EMBODIMENT

Figure 1:
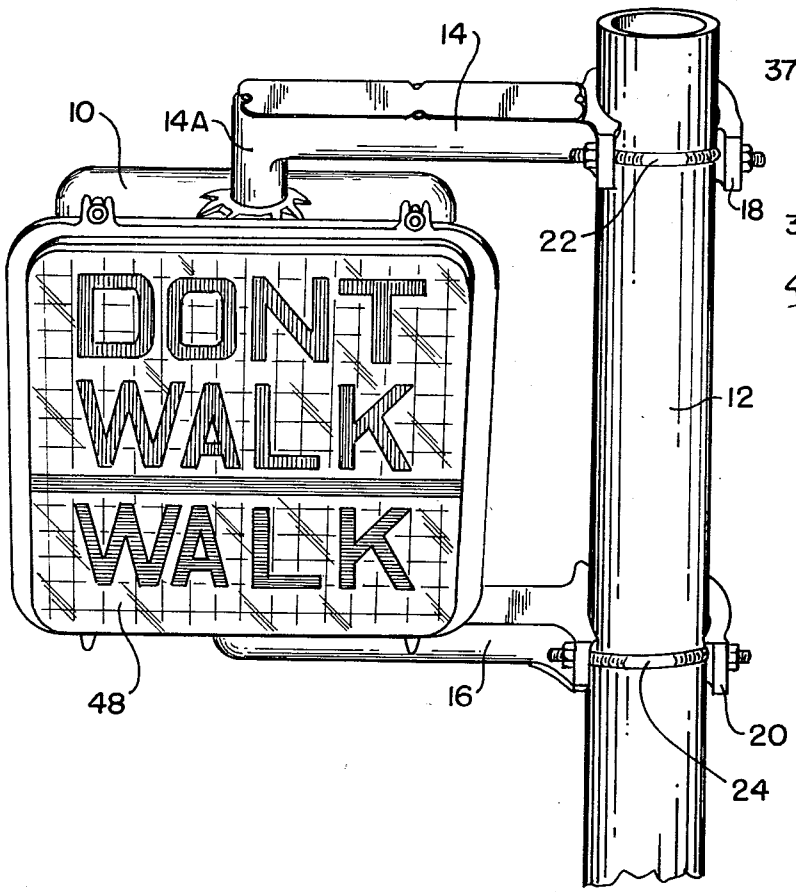
FIG. 1 is a representation of a traffic signal of the type disclosed in the aforementioned Copending Application Ser. No. 810,168, and which may be constructed to incorporate the rotatable socket of the present invention, the traffic signal being shown as supported on a standard by supporting brackets of the type described and claimed in Copending Application Ser. No. 766,612 filed Feb. 7, 1977 now U.S. Pat. No. 4,142,173, issued Feb. 27, 1979 in the name of the present inventors.
Figure 3:
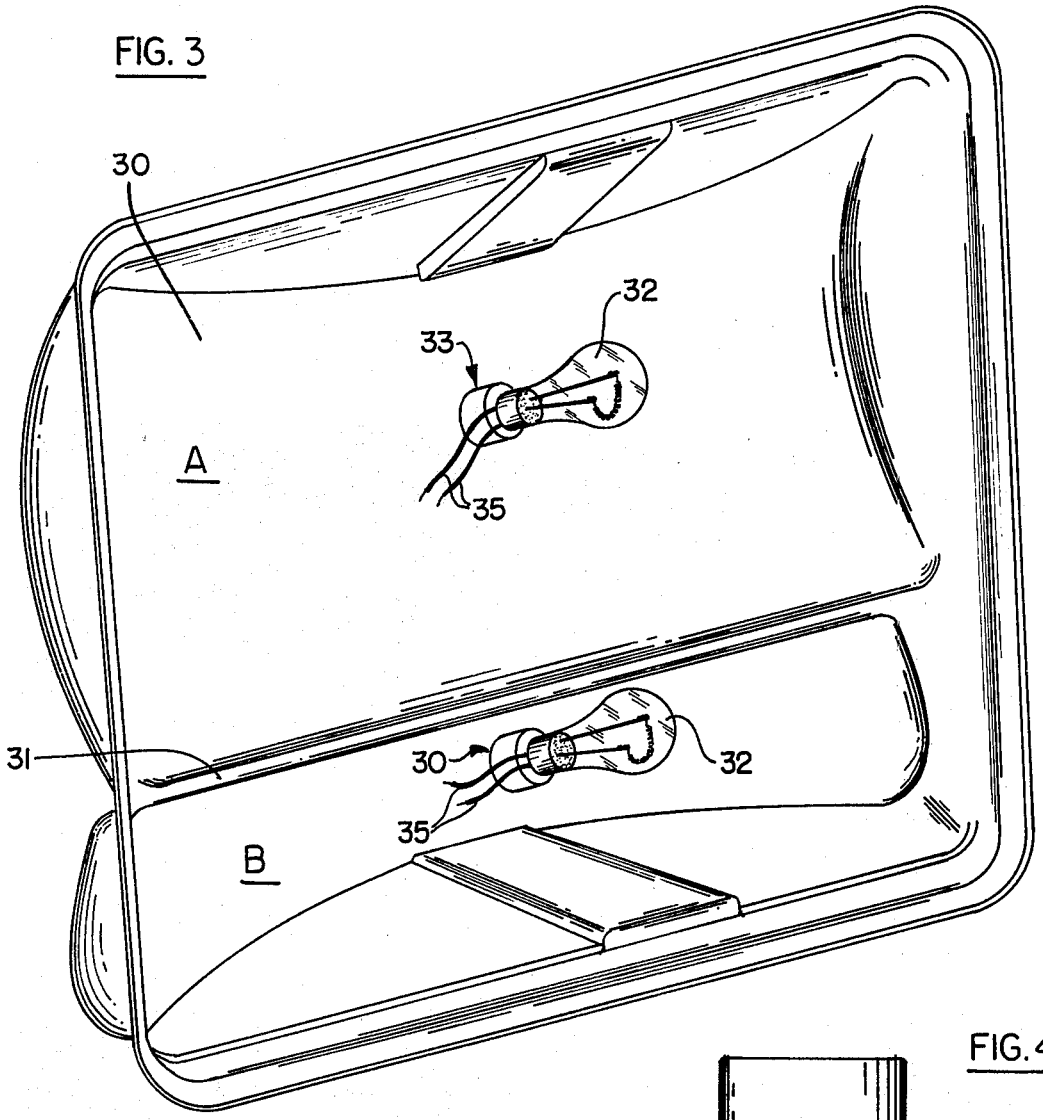

As shown in FIG. 1, a rectangular-shaped pedestrian signal case 10 is mounted on a hollow upright supporting pole 12 by a pair of elongated brackets 14 and 16. The elongated brackets each has an integral protuberance, such as protuberance 14A, at the distal ends thereof, and these protuberances extend into mounting holes, such as the hole 10B of FIG. 2, in the upper and lower sides of the case 10, the protuberances being attached to the case by appropriate fastening means.

Brackets 14 and 16, as described in Patent Application Ser. No. 766,612, are supported on pole 12 by shoes, such as shoes 18 and 20, and by bolts, such as bolts 22 and 24, which extend between the ends of the brackets 14, 16 and shoes 18, 20. In the illustrated embodiment the bolts 22 and 24 have an arcuate configuration to extend partially around the peripheral surface of the pole.

Figure 2:
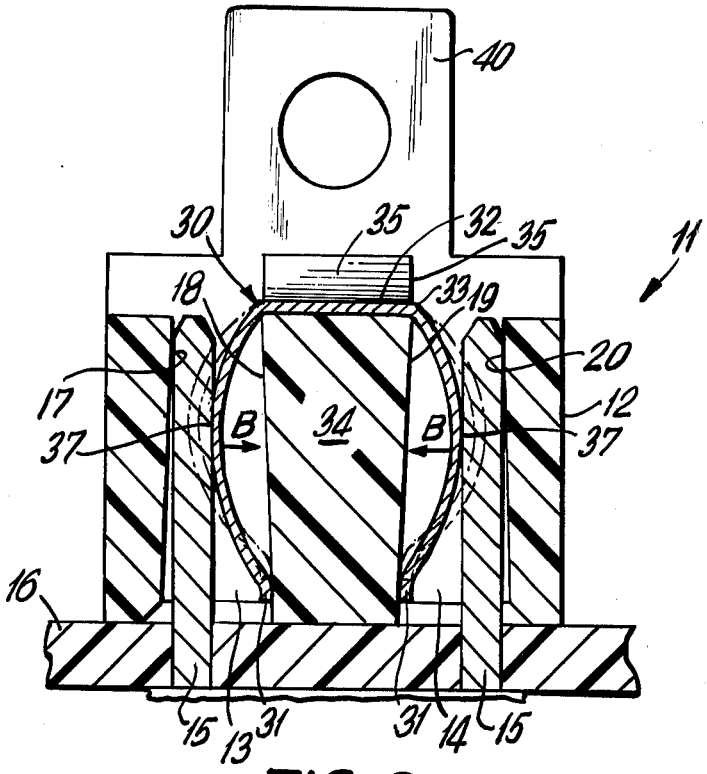
FIG. 2 is a view of the pedestrian signal of FIG. 1, with certain of its components turned down to reveal the interior of the housing and to show the rotatable sockets of the invention.
Figure 3:
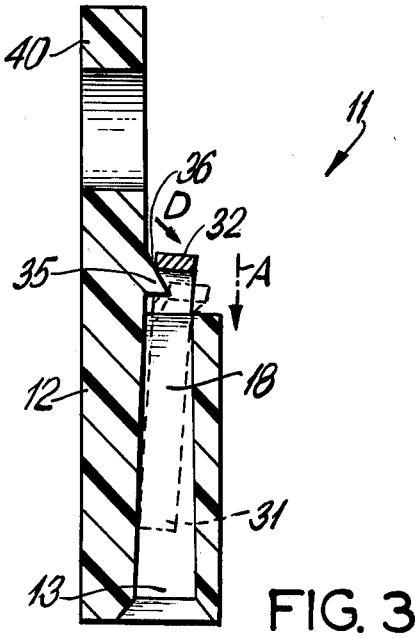
FIG. 3 is a front perspective view of the housing, with the cover and face mask removed, to show the position of the incandescent lamps within the housing.
Figure 2:
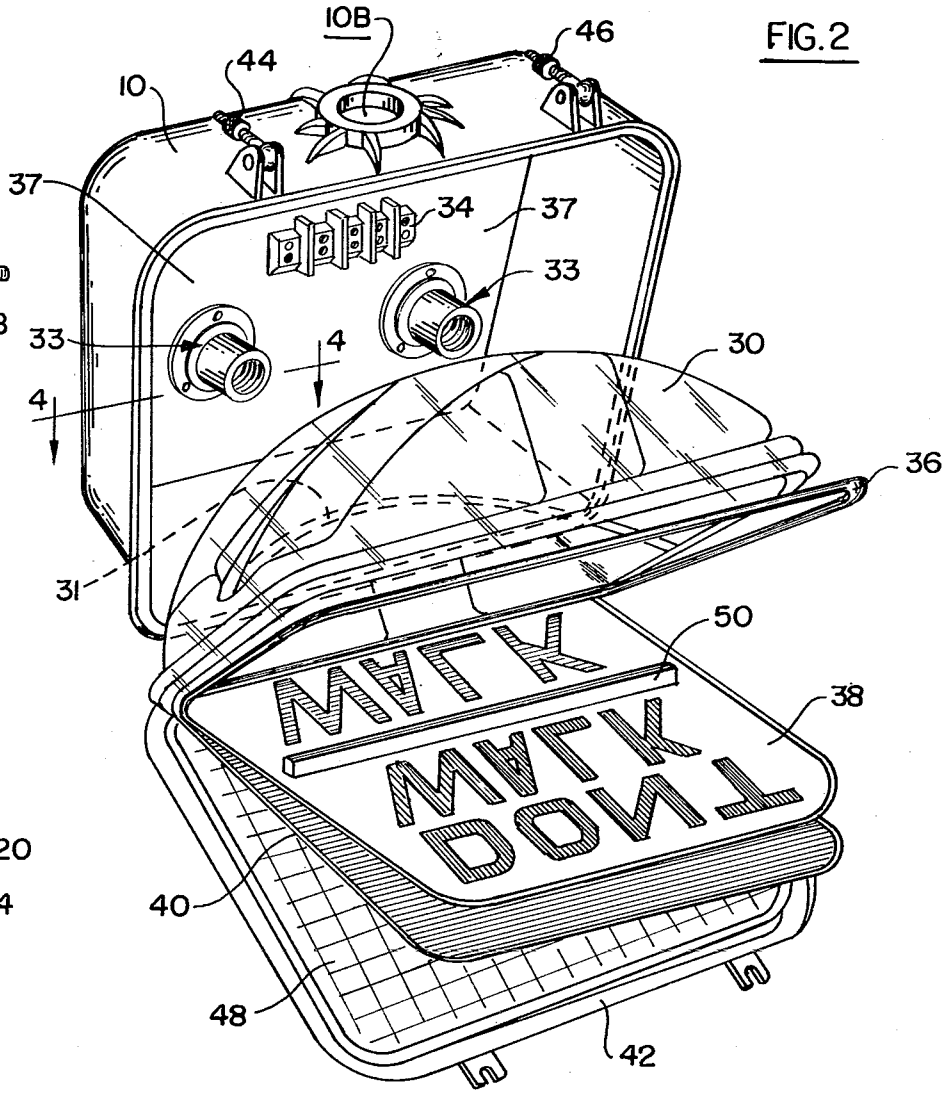

Case 10 may have a rectangular structural configuration, such as shown in FIG. 2, and it includes mounting holes, such as the mounting hole 10B in its top and bottom sides. The signal unit described in Copending Application Ser. No. 810,168 includes a housing 30 which is adapted to fit into the rectangular case 36, and which has a partition 31 (FIGS. 2 and 3) separating the housing into two compartments A and B. Housing 30 is shaped so that the rear wall of each of the compartments A and B has a parabolic configuration, with incandescent lamps 32 screwed into sockets 33 in the two compartments at the focal points of the respective parabolic surfaces. The incandescent lamps are held by the sockets in a horizontal position, and the sockets are constructed, in accordance with the present invention, to be rotatable, so that each of the lamps may be turned to a desired angular position for the reason mentioned above. The sockets are connected to electric leads 35 which extend from the sockets to an appropriate terminal board 34 mounted on the rear wall of case 10, as shown in FIG. 2. Energizing leads (not shown) connected from the electric mains are connected to the terminal board 34.

Sockets 33 and terminal board 34 are mounted on a heat conductive plate 37 in the rear of the case 10, plate 37 being formed of aluminum, or other appropriate material, to act not only as a mount for the sockets and terminal strip, but also as a heat sink.

A gasket 36 is provided which fits into a channel extending around the periphery of the open front of housing 30. A face plate 38 is mounted in front of the housing to close the open front of the housing. As mentioned above, the words "DONT WALK" are inscribed on one portion of the face plate 38, and the word "WALK" is inscribed on a second portion. A partition 50 is mounted on the face plate, and the partition extends out from the rear surface of the face plate between the words "DONT WALK" and the word "WALK". The partition 50 is preferably formed of resilient material which engages the edge of partition 31, so that the elements 50 and 31 may form an effective light barrier between the two compartments so as to assure that when one of the lamps 32 is energized only the word "WALK" on the lower portion of the face plate will be illuminated, and when the other of the lamps 32 is energized only the words "DONT WALK" on the upper portion of the face plate will be illuminated.

The face plate 38 is held within the case 10 by means of a frame 42 which is hinged to the lower edge of the case, and which is held in a closed position against the case by shackle bolts 44 and 46. An egg crate visor 48 of the type described in U.S. Pat. No. 3,863,251, which issued Jan. 28, 1975 to the present inventors, is mounted on frame 42 on the front face 38. A light control film 40, which is also described in U.S. Pat. No. 3,863,251, is mounted adjacent to visor 48.

Figure 4:
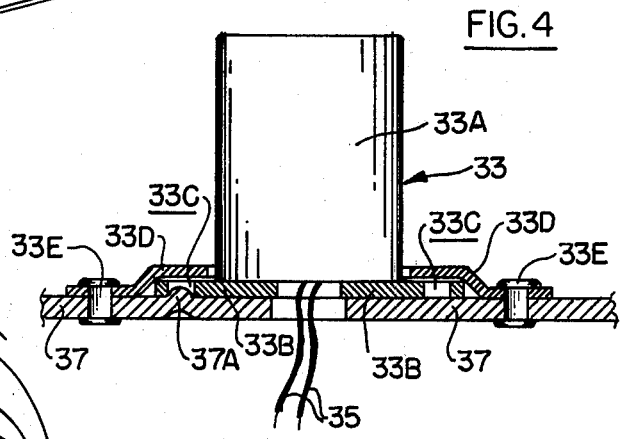
FIG. 4 is a sectional view of one of the sockets of FIG. 2, taken essentially along the line 4—4 of FIG. 2.
Figure 5:
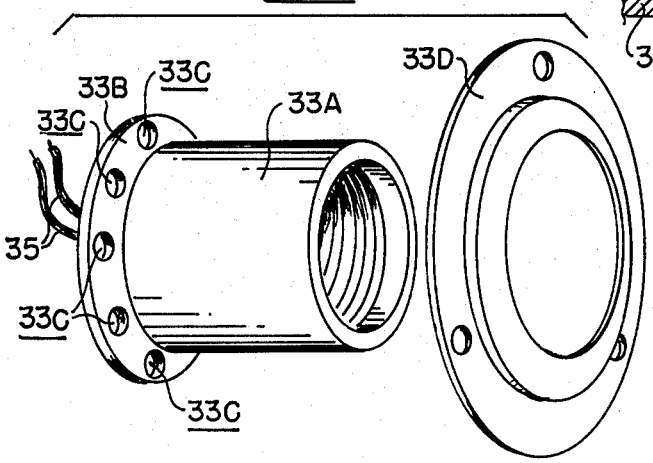
FIG. 5 is a detached perspective view of the socket of FIG. 4.

As shown in FIG. 4, each of the lamp sockets 33 includes a cylindrical-shaped socket portion 33A which has internal threads to receive the base of the corresponding incandescent lamp 32. A flange 33B is affixed to the lower end of the member 33A, and the flange is equipped with a series of detent holes 33C extending around its perimeter (FIGS. 4 and 5). A detent 37A (FIG. 4) is formed in the plate 37 in position to be received in the detent holes 33C. A mounting ring 33D fits over the socket portion 33A and over the flange 33B to mount the assembly on plate 37, and the mounting ring is fastened to the plate by a plurality of rivets 33E, or other suitable fasteners.

Whenever it is desired to adjust the angular position of either one of the lamps 32, the corresponding socket 33A is grasped and tilted slightly to release detent 37A from the particular detent hole 33C, and the socket is then turned within the confines of the mounting ring 33D to permit other detent holes 33C successively to receive the detent 37A. When the socket is set to its desired angular position, a corresponding one of the detent holes 33C receives the detent 37A, and the socket is released and permitted to assume an upright position, and is firmly supported at the desired angular position by the detent.

It will be appreciated that although a particular embodiment of the invention has been shown and described, modifications may be made. It is intended in the claims to cover the modifications which fall within the true spirit and scope of the invention.

What is claimed is:

1. In combination: a mounting plate having a detent therein, and a rotatable lamp socket mounted on said mounting plate for supporting an electric lamp, said rotatable lamp socket comprising: a tubular-shaped socket portion for receiving the electric lamp; a flange mounted at one end of the socket portion and extending radially beyond the peripheral surface thereof, said flange having a plurality of detent holes therein for successively receiving the detent in the mounting plate as the socket is rotated; and a mounting ring coaxial with said flange and socket portion and extending over the surface of said flange and radially outwardly beyond the perimeter of said flange; and fastening means attaching said mounting ring to said mounting plate.

2. The combination defined in claim 1, and which includes means for mounting said mounting plate in an upright position so that said lamp socket supports said lamp in an essentially horizontal position.

3. The combination defined in claim 1, in which said mounting plate is formed of heat conductive material so as to serve additionally as a heat sink.

4. The combination defined in claim 1, in which said mounting ring is configured to press said flange against said mounting plate to cause said detent to be received in one of said detent holes in said flange, and in which said mounting ring is sufficiently resilient to permit the socket portion and flange to be tilted so as to release the detent from the detent hole.

* * * * *